United States Patent [19]

Bodelson et al.

[11] 4,193,537

[45] Mar. 18, 1980

[54] CENTRIFUGAL SEPARATOR WITH PRESEDIMENTATION MEANS

[75] Inventors: Berth I. A. Bodelson, Tullinge; Mats B. Nordenberg, Tumba, both of Sweden

[73] Assignee: Alfa-Laval AB, Tumba, Sweden

[21] Appl. No.: 953,933

[22] Filed: Oct. 23, 1978

[30] Foreign Application Priority Data

Nov. 1, 1977 [SE] Sweden ..... 7712307

[51] Int. Cl.[2] ..... B04B 1/14

[52] U.S. Cl. ..... 233/20 A

[58] Field of Search ..... 233/20 R, 20 A, 19 R, 233/7, 46; 137/853

[56] References Cited

U.S. PATENT DOCUMENTS 3,231,149 1/1966 Yuza ..... 137/853

3,871,575 3/1975 Niemeyer ..... 233/20 A

FOREIGN PATENT DOCUMENTS 545386 3/1977 U.S.S.R. ..... 233/7

*Primary Examiner*—George H. Krizmanich

*Attorney, Agent, or Firm*—Cyrus S. Hapgood

[57] ABSTRACT

The centrifugal rotor contains a distributor forming a conical wall having openings through which the central inlet chamber is connected to the separating space, the inlet chamber also being connected through a presedimentation space to a peripheral sludge space by way of an annular slot located radially outward from said openings. An annular flexible valve for the slot has one side directed toward the presedimentation space and an opposite side directed toward the peripheral sludge space, the valve being operable to close said slot when subjected to substantially equal liquid pressures on said sides thereof and to open the slot upon creation of a substantial pressure difference on said sides in response to opening of outlets from the peripheral sludge space.

5 Claims, 2 Drawing Figures

CENTRIFUGAL SEPARATOR WITH PRESEDIMENTATION MEANS

Figure 1:
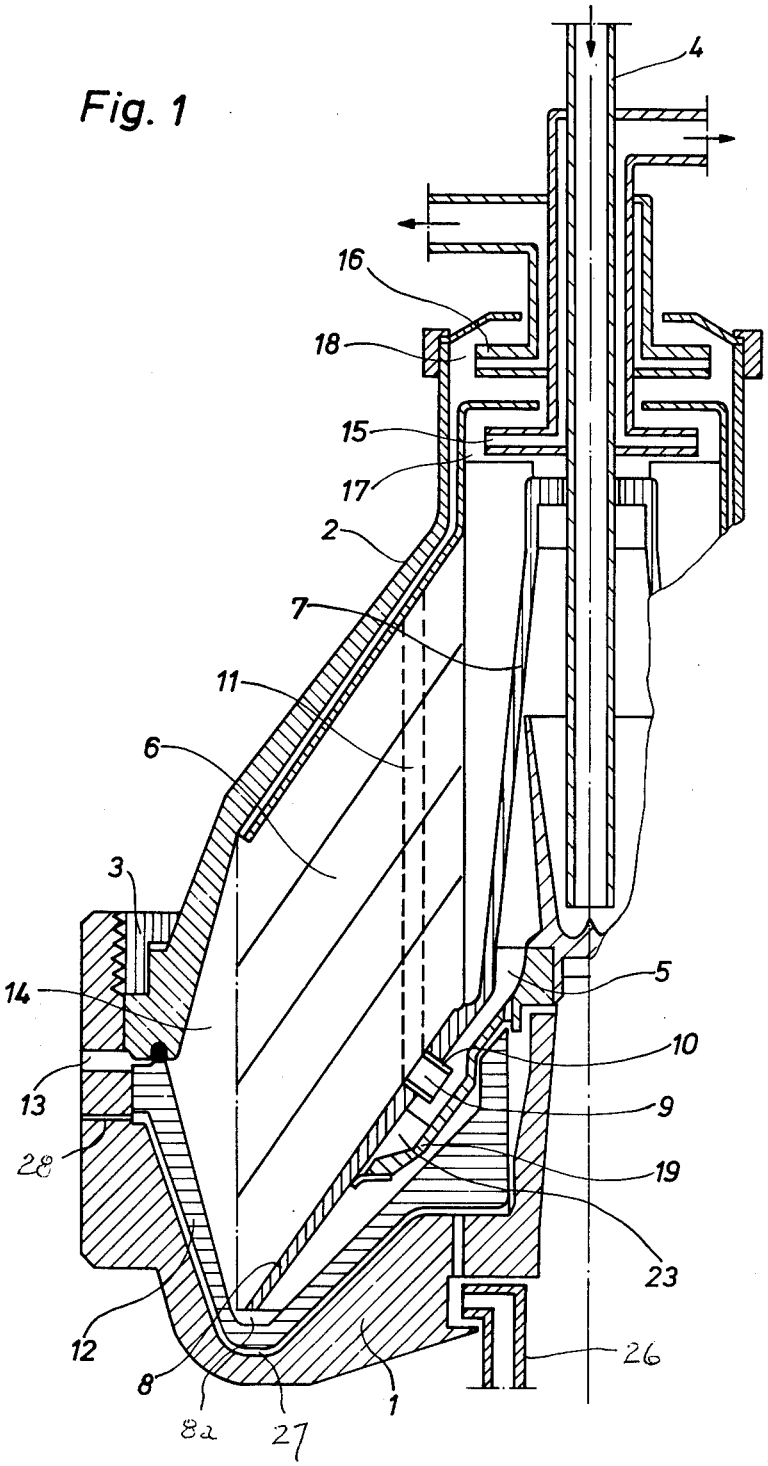

The present invention relates to a centrifugal separator with intermittent sludge ejection controlled by an axially movable valve bowl within the rotor, the rotor being provided with a stack of conical separation disks and openings being provided in the conical distributor of the rotor connecting the central inlet chamber of the rotor to the separating space of the rotor, the inlet chamber being connected to the peripheral sludge space of the rotor via a ring slot.

Centrifugal separators for separating a liquid mixture into two liquid phases and one sludge phase are used for milk separation. The incoming flow in such centrifugal separators enters through openings in the conical distributor of the rotor and flows up through distribution holes in the conical separation disks, the flow being directed into the narrow spaces provided between the separation disks. Most of the impurity particles in the whole milk pass through these narrow spaces without difficulty and deposit in the sludge space of the rotor. There are particles, however, of such size and form that they may clog the narrow spaces around the distribution holes, the capacity of the centrifugal separator thus being impaired. The risk of clogging can be minimized if presedimentation is provided within the rotor, which means that the largest particles are separated and transferred intermittently directly to the sludge space of the rotor, instead of being admitted to the stack of separation disks. In the German As No. 23 13 669, a centrifugal separator is described having a device for presedimentation within the rotor. The bowl valve is provided at its radially inner part with a cylindrical surface directed radially outwards to cooperate with a corresponding cylindrical surface in the lower side of the conical distributor. When the bowl valve is closed, the cylindrical surfaces cooperate to form a closed sedimentation space below the conical distributor. When the bowl valve moves to its open position, the cylindrical surfaces no longer cooperate, and a discharge slot is created. Thus, during operation, sludge containing relatively large particles is collected in the sedimentation space. When the bowl valve is opened intermittently to eject sludge from the sludge space of the rotor, a passageway is opened from the inlet chamber to the sludge space, and the sludge of large particles follows the rest of the sludge out of the centrifugal separator, more or less.

There are some drawbacks with this prior design. It is not possible to achieve an efficient sealing between said cylindrical surfaces. There must be a certain overlapping to minimize the unavoidable leakage. Upon partial discharge of the rotor, the width of the ring slot through which the sludge of relatively large particles must pass will not be large enough, manufacturing tolerances also contributing to this difficulty. To guarantee a safe discharge of the presedimented phase, a much wider ring slot is required.

The principal object of the present invention is to provide a centrifugal separator of the type previously mentioned which allows an efficient presedimentation within the rotor by the aid of simple and safe means.

According to the invention, this object is attained by providing a ring-formed flexible valve means which, with substantially equal liquid pressures prevailing on the side of the valve means directed towards the inlet chamber and on the side directed towards the peripheral sludge space, keeps the ring slot closed radially outwards of the openings to the disk stack to form a presedimentation space, and which opens the ring slot when sludge is ejected from the centrifugal separator, a pressure difference between said sides of the valve means then being created.

According to one preferred embodiment, the valve means consist of a flat rubber ring fixed along its radially inner edge in a stationary cone which is fixed relative to the lower part of the rotor. It is also possible, however, to fix the flexible valve means along its radially outer edge, in the conical distributor, in a closed position permitting it to abut against a cone which is stationary relative to the lower part of the rotor.

In a further advantageous embodiment of the invention, the openings connecting the inlet chamber to the separating space are surrounded by sleeves directed towards the inlet chamber. With this arrangement, relatively large impurity particles are prevented from following the flow up through the distribution holes, instead of being exposed to presedimentation due to the centrifugal force.

Figure 2:
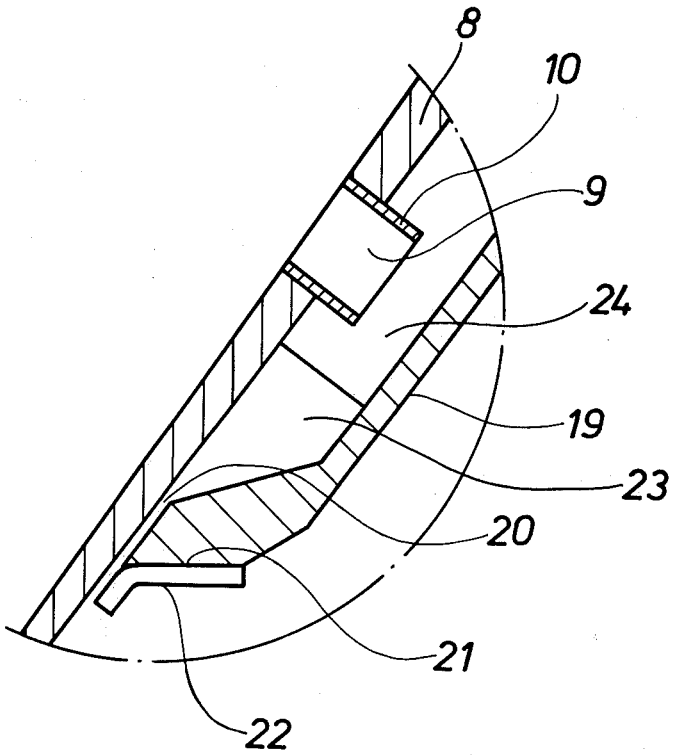

One embodiment of the invention will now be described in detail with reference to the accompanying drawing, in which FIG. 1 shows an axial section through the left half of a centrifugal separator according to the invention, with the flexible valve means in a closed position, and FIG. 2 shows a detail of FIG. 1 on a larger scale, with the valve means in an open position.

In FIG. 1, the rotor has a lower part 1 and an upper part 2. These parts are kept together by a lock ring 3. Through a stationary inlet pipe 4, the liquid mixture to be separated is fed into the inlet chamber 5 of the rotor, which is separated from the separating space 6 of the rotor by a distributor 7, the latter at its lower part being formed as a cone 8. This cone is provided with openings 9 surrounded by sleeves 10 and leading to distribution holes 11 in conical separation disks, which are located in the separating space 6 but are not shown in detail. The rotor is provided with a bowl valve 12 movable axially of the rotor and which is opened intermittently for ejecting sludge collected in the sludge space 14 of the rotor, the sludge being ejected through discharge ports 13. Inner and outer paring disks 15 and 16 discharge the two separated liquid phases from inner and outer paring chambers 17 and 18, respectively.

A substantially conical annular disk 19 is fixed so that it remains stationary relative to the lower part 1 of the rotor. This conical disk extends radially outward past the openings 9 and coacts with the conical distributor 8 to form an annular or ring slot 20, as shown in FIG. 2. The outer edge of this conical disk 19 (FIG. 2) is provided with a horizontal supporting surface 21 against which a flat flexible ring 22 is fixed by suitable means (not shown), as by bolts or by pressing it into a dovetail groove. The flexible ring 22 is fixed to the outer surface 21 of the disk in such a way that it is pressed against the surface of the conical distributor 8, whereby the ring slot 20 is closed to form a closed sedimentation space 23. To make the capacity of this sedimentation space 23 large enough, the radial extension of the conveyor baffles 24, which are fixed to the lower side of the conical distributor 8, should not be too large. The annular slot 20 communicates with sludge space 14 through an annular passage **8*a* at the outer edge of cone 8**.

When the bowl valve 12 is closed (raised as shown in FIG. 1), there is no significant flow from below distributor 8 through annular passage 8*a* into sludge space 14. Consequently, the pressure on both sides of the ring 22 is substantially equal, whereby the ring 22 keeps the ring slot 20 and thus the sedimentation space 23 closed (FIG. 1). When the bowl valve 12 opens for sludge ejection, the discharge of material through parts 13 causes the pressure in the space at the lower side of the flexible ring 22 (the space leading through passage 8*a* to the sludge space 14) to decrease substantially relative to the pressure in sedimentation space 23 and thus make the ring yield, permitting the discharge of sludge consisting of relatively large impurity particles collected by presedimentation.

The inventiion permits use of a relatively large ring slot 20, which easily allows any impurity particles to pass, without impairing the closing operation.

Centrifugal separators according to the invention are intended primarily for the separation of an incoming mixture into two liquid phases and one sludge phase. In such separators, there is a disk stack provided with distribution holes. However, there are also certain special centrifugal separators intended for separating an incoming mixture into a single liquid phase and one sludge phase, the disk stack being provided with distribution holes which are usually close to the radially outer edges of the disks. Even centrifugal separators of this type may be arranged according to the invention with a ring-formed flexible means for presedimentation.

The vertical movements of valve bowl 12 open and close the peripheral discharge ports 13 are effected in a conventional manner under control of an operating liquid supplied through tube 26 to the space 27 between the valve bowl and the rotor bottom 1, this space having peripheral drainage holes 28.

As will be apparent from the foregoing, the annular slot 20 is formed by opposed annular surfaces which are spaced from each other and which are fixed relative to the rotor 1–3. Moreover, the flexible ring or valve means 22, being secured to the annular disk 19, is also fixed relative to the rotor. Thus, although the flexible ring 22 responds to the opening and closing movements of bowl valve 12, the ring movements are not the same as the bowl valve movements and actually lag slightly behind the later movements.

We claim:

1. A centrifugal separator comprising a rotor forming a separating space and also a peripheral space for receiving separated sludge from the separating space, the rotor having peripheral outlets for discharging the separated sludge, a valve bowl movable axially in the rotor to open and close said sludge outlets, a stack of conical separation disks in said separating space, the rotor having a central inlet chamber for receiving a sludge-containing mixture to be centrifuged, a distributor forming a conical wall having openings through which said inlet chamber is connected to said separating space, the rotor also having opposed annualar surfaces fixed relative to the rotor and forming between the surfaces an annular slot through which said inlet chamber is connected to said peripheral sludge space independently of said wall openings, there being a presedimentation space located radially outward from said openings and leading from said inlet chamber to said annular slot, and annular flexible valve means for said slot, said valve means being fixed to the rotor and having one side directed toward the presedimentation space and an opposite side directed toward the peripheral sludge space, said valve means being operable to close said slot when subjected to substantially equal liquid pressures on said sides thereof and to open said slot upon creation of a substantial pressure difference on said sides in response to opening of said sludge outlets.

2. The separator of claim 1, in which said valve means consists of a flat rubber ring.

3. The separator of claim 1, in which one of said opposed annular surfaces is formed by a conical disk member which is fixed relative to the rotor and located at the opposite side of said conical wall from said separating space, said disk member partly defining said presedimentation space, said valve means having a radially inner edge portion along which the valve means is fixed to said disk member.

4. The separator of claim 1, comprising also sleeves surrounding said conical wall openings and projecting from said wall in the direction away from the separating space.

5. The separator of claim 1, in which said conical wall has an outer edge partly defining an annular passage through which said annular slot communicates with the peripheral sludge space.

* * * * *